United States Patent [19]

Ishimura

[11] Patent Number: 4,461,940

[45] Date of Patent: Jul. 24, 1984

[54] FAIL-SAFE DEVICE FOR USE IN A HEATING APPARATUS

[75] Inventor: Yohzoh Ishimura, Kashihara, Japan

[73] Assignee: Matsushita Electric Industrial Co., Ltd., Osaka, Japan

[21] Appl. No.: 364,937

[22] PCT Filed: Aug. 27, 1981

[86] PCT No.: PCT/JP81/00198

§ 371 Date: Mar. 25, 1982

§ 102(e) Date: Mar. 25, 1982

[87] PCT Pub. No.: WO82/00873

PCT Pub. Date: Mar. 18, 1982

[30] Foreign Application Priority Data

Aug. 29, 1980 [JP] Japan ..... 55-120041

[51] Int. Cl.[3] ..... H05B 6/68

[52] U.S. Cl. ..... 219/10.55 C; 219/10.55 B; 126/197; 200/50 A

[58] Field of Search ..... 219/10.55 C, 10.55 D, 219/10.55 B; 126/197; 200/50 R, 50 A, 61.62, 61.64, 61.76–61.82; 307/141, 141.4, 141.8

[56] References Cited

U.S. PATENT DOCUMENTS

| | | | |
|---|---|---|---|
| 3,733,456 | 5/1973 | Blackburn | 219/10.55 C |
| 4,006,121 | 2/1977 | Isono | 219/10.55 C X |
| 4,345,144 | 8/1982 | Bergquist | 126/197 X |

FOREIGN PATENT DOCUMENTS

| | | | |
|---|---|---|---|
| 52-20454 | 2/1977 | Japan | 219/10.55 C |
| 52-49807 | 11/1977 | Japan | 219/10.55 C |
| 53-124340 | 10/1978 | Japan | 219/10.55 C |
| 53-136739 | 11/1978 | Japan | 219/10.55 B |
| 54-65847 | 5/1979 | Japan | 219/10.55 C |

*Primary Examiner*—Roy N. Envall, Jr.
*Assistant Examiner*—Philip H. Leung
*Attorney, Agent, or Firm*—Wenderoth, Lind & Ponack

[57] ABSTRACT

This invention relates to a fail-safe device for use in heating appliances including an electric oven and a microwave oven. More particularly it relates to a fail-safe device which includes an electronic control circuit 28 for controlling a main circuit of the heating appliance and a mechanical latch for unlocking actuator levers 39, 44 and 45 for fail-safe switches 26, 27, 29 and 30 responsive to the opening and closing movement of a door 3 and to the turning on of a switch 31 in the main circuit upon mechanical actuation of a cook start button 7. There is, therefore, no danger that the appliance may be self-triggered due to the failure of the electronic control circuit 28, incoming noise, a surge of lightning, electrostatic noise, momentary power failure, etc., and become operative when it is not desirable.

4 Claims, 8 Drawing Figures

FAIL-SAFE DEVICE FOR USE IN A HEATING APPARATUS

BACKGROUND OF THE INVENTION

1. Technical Field of the Invention

This invention relates to a fail-safe device for use in a heating appliance, such as an electric oven and a microwave oven, and more particularly it relates to a fail-safe device which includes an electronic control circuit for controlling a main circuit of the heating apparatus and a so-called mechanical latch for unlocking an actuator lever fo a fail-safe switch responsive to the movement of a door and for turning on a switch in the main circuit, upon mechanical actuation of a cook start button for starting cooking, thereby rendering a control system for the heating apparatus operative only when the user mechanically depressing the cook switch.

2. Background Prior Art

The heating appliance of the above described type is in danger that it may be self-triggered due to incoming noise, a surge of lightning, electrostatic noise, momentary power failure, etc. and become operative when it is not desirable.

It is most dangerous for the heating appliance of the above type that it may start heating inadvertently notwithstanding no start instruction has been applied to a control system for heating. Under these circumstances, the temperatures of the appliance and the door rise extraordinally and the user may burn himself on these portions or the appliance itself may catch fire and burn surrounding inflammables such as a curtain.

In addition, non-loaded heating in a microwave oven results in increasing the quantity of microwave radiations leaking from the periphery of the door and impairing greatly the lives of power unit components such as a magnetron.

With the recent remarkable development of the electronic control circuit technology using microcomputers, microcomputer-based appliances are growing in number. Even though in those appliances electronic control circuits and softwares stored in the microcomputer are designed with a sufficient allowance or provision for coping with a surge of lightning, a momentary power failure and so forth, the microcomputer sometimes performs a faulty operation due to such surge of lightning or momentary power failure or a drop in power supply voltage, for instance.

For example, there is the possibility of burning the interior of the heating chamber, the appliance itself, other equipment or furniture when the appliance inadvertently becomes operative during the night time.

To prevent the above accident beforehand, a mechanical power switch is additionally provided. However, this switch results in increasing the number of actuations, impairing the convenience of the user of the appliance, and if the power switch is kept on, causing the above-mentioned accident. The mechanical latch method is effective for those reasons but it is not available for use in a microcomputer-controlled high frequency heating appliance.

In recent years, a mechanical latch method has been proposed in lieu of an electromagnetic relay method in an attempt to simplify not only circuit structure but also mechanical control. With the former method, a lever operatively interlocked with a door is unlocked to turn on a switch for a main circuit upon actuation of a cook start button. With the latter method, an electromagnetic relay coil is energized to turn on a main circuit for a relay main circuit upon depression of the cook start button.

The reason why the mechanical latch method is not available for use in the microcomputer-controlled microwave oven is due to the fact that the mechanical latch switch serves as a cook start switch per se.

The microcomputer, on the other hand, demands a cook start signal switch. Although it might be contemplated to stack this switch on the mechanical latch switch, this approach will face the following difficulties.

Once the cook start button is depressed, the cook start signal switch is turned on and remains in that state. If the cook start button is depressed before selection of a desired kind of cooking, i.e. one of such cooking modes as re-heating with a high output level, cooking with a high output level, defrosting with a low output level, simmering with high and low output levels, heater cooking with top and bottom heaters, cooking with the top heater only for browning, cooking with the bottom heater only, fermentation with low output level heater control, heater cooking with hot air circulation, etc., in the case of a high frequency heating appliance having the electric heater built therein, the microcomputer causes the various mechanisms of the appliance to operate as long as the cook start button is in depressed position. Then, as a cook selection switch is manipulated, various switches are switched in live or energized condition, thus detracting considerably from the serviceable lives and dependability of the switches.

SUMMARY OF THE INVENTION

Accordingly, it is an object of the present invention to provide an improved mechanical latch method by which the above discussed problems are overcome and safety of a control circuit is assured by not turning on a main circuit without a mechanical latch being switched on. Some embodiments of the present invention will be described with reference to the accompanying drawings.

BEST MODE FOR CARRYING OUT THE PREFERRED EMBODIMENTS

Figure 1:
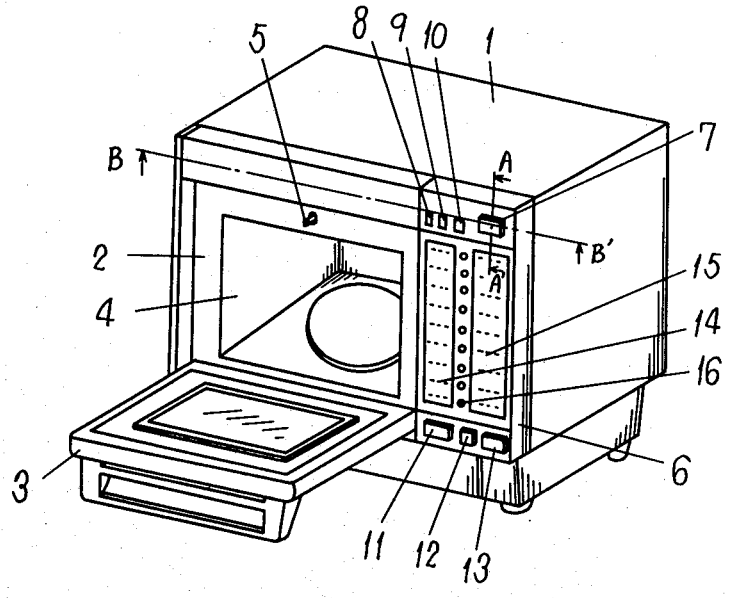
FIG. 1 is a perspective view of a heating appliance according to an embodiment of the present invention, with a door in open position.

Referring now to FIG. 1, there is illustrated a door 3 for freely opening and closing a front opening 2 in a main body 1. A heating chamber 4 is defined within the main body 1. A door switch actuator 5 is protrudes from and is disposed over the front opening 2.

In the front face of the main body 1 there is provided an operational panel 6 in juxtapositional relation with the door 3 together with a cook start button 7 and cook display lamps 8, 9 and 10 above the operational panel 6. The cook display lamp 8 shows the operational state of a microwave oven, the lamp 9 shows that of an electric oven, and the lamp 10 shows that of grill heating.

Disposed below the operational panel 6 are a microwave oven menu selection key 11, an electric oven/grill menu selection key 12, and a cancel key 13 which serves also as a stop key to interrupt menu selection and discontinue heating during the course of cooking. There is further disposed about the center of the operational panel 6 a menu table 14 for microwave cooking, a second menu table 15 for electric oven/grill cooking, and a plurality of display elements 16 such as LED's intervened therebetween.

When a menu is selected, the menu selection key 11 or 12 is depressed so that either of the menu tables 14 or 15 is lighted and the uppermost display element 16 is fired at the same time. Whenever the user taps the menu selection key 11 or 12 the fired one of the display elements 16 moves down. Provided that the cook start button 7 is depressed at the time when the fired display element 16 is in alignment with a desired menu position, heating starts and the corresponding one of the cook display lamps 8, 9 and 10 is enabled. Cooking is conducted after a food (not shown) is disposed in the heating chamber 4 the door 3 is closed. The period of cooking is controlled under an electronic control circuit as discussed hereinafter.

Figure 3:
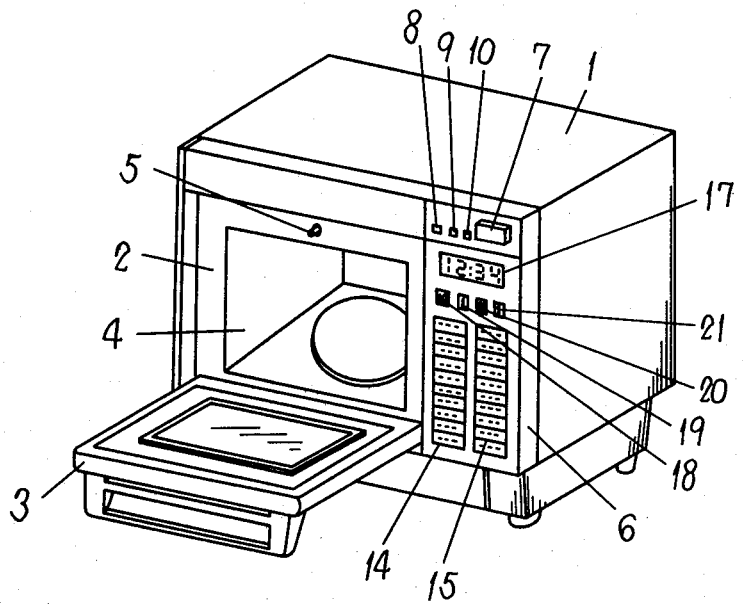
FIG. 3 is a perspective view of another embodiment of the present invention.
Figure 5:
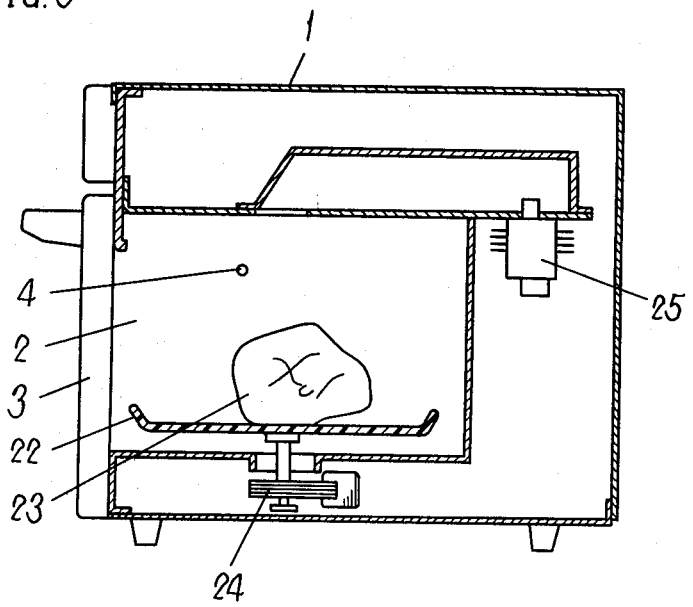
FIG. 5 is an elevational cross sectional view of FIG. 1.
Figure 6:
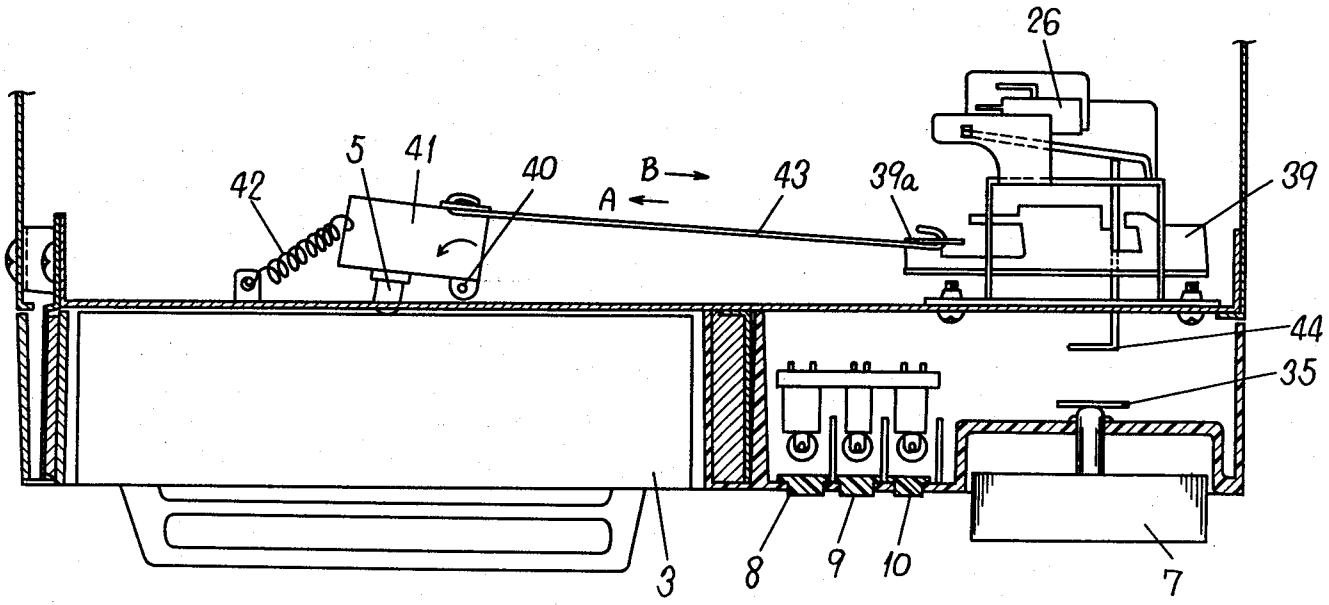
FIG. 6 is an enlarged cross sectional view taken along the line B—B' in FIG. 1.

FIG. 3 illustrates another embodiment wherein menus in the menu table 14 or 15 are selected upon actuations of menu setting keys. Disposed over the operational panel 6 are a display panel 17 for timepiece or timer display and entry keys 18, 19,20 and 21 for introducing 4-digit inputs into the display panel 17. In FIG. 5, a food 23 mounted on a turntable 22 in the heating chamber 4 is dielectrically heated by microwaves radiated from a high frequency oscillator or a magnetron 25, while being rotated by a motor 24.

A control system will be described by reference to FIG. 2.

Door switches 26 and 27 switchable into open or closed position upon the opening or closing movement of the door 3 are connected in series with a main circuit. A cook start button 7 is connected to a cook switch 29 in an electronic control circuit 28 and a door open/close signal switch 30 associated with the door 3. The function of the electronic control circuit 28 is to energize an electromagnetic relay 31 placed in the main circuit and to excite a high frequency generator circuit 32 including the magnetron 25. A monitor switch 33 disposed in the main circuit is switched between open and closed positions in response to the opening or closing movement of the door 3. In the event the door switches 26 and 27 are opened or closed upon the movement of the door 3 but there is any fault in the door switch 26, a blow 34 will fuse to protect the main circuit against such fault.

Figure 4:
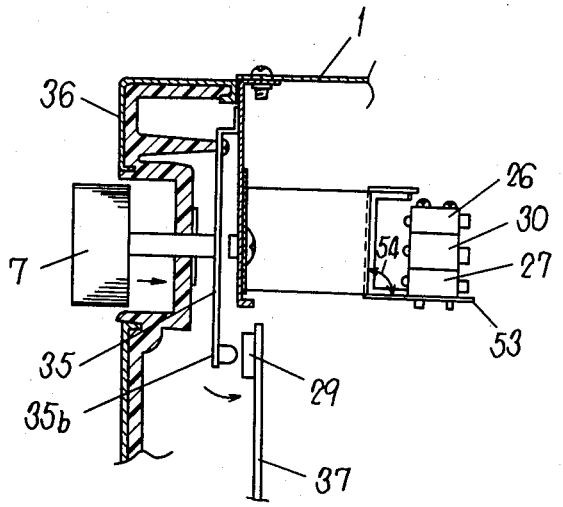
FIG. 4 is a cross sectional view taken along the line A—A' in FIG. 1.
Figure 7:
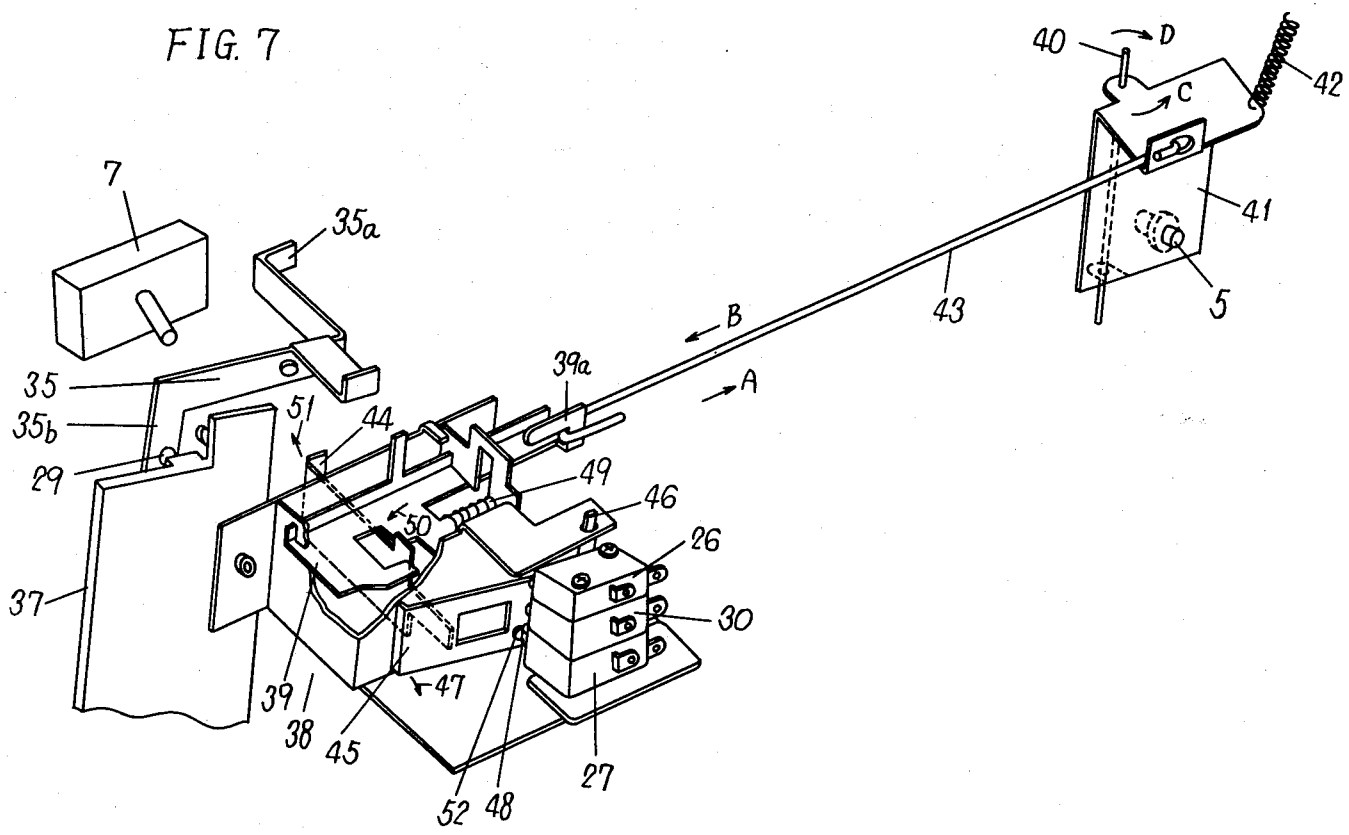
FIG. 7 is an enlarged perspective view of a latch assembly as one of the major components.

In FIG. 7, a mechanical latch is illustrated. A resilient actuator arm 35 secured in the main body 1 has its one end 35*a* fixed on an ornament plate 36, shown in FIG. 4, and its opposite end 35*b* held in engageable relationship with a cook start switch 29 seated on a circuit board 37 carrying the electronic control circuit 28. A switch assembly 38 is made up of the mechanical latch and an electromagnetic relay circuit in combination. One end 39*a* of a switch lever 39 is so operatively interlocked with the door switch actuator 5 as shown in FIGS. 1 and 3 that it may move in the direction of arrow A and in the direction of arrow B, respectively, when the door 3 is opened and closed.

Figure 2:
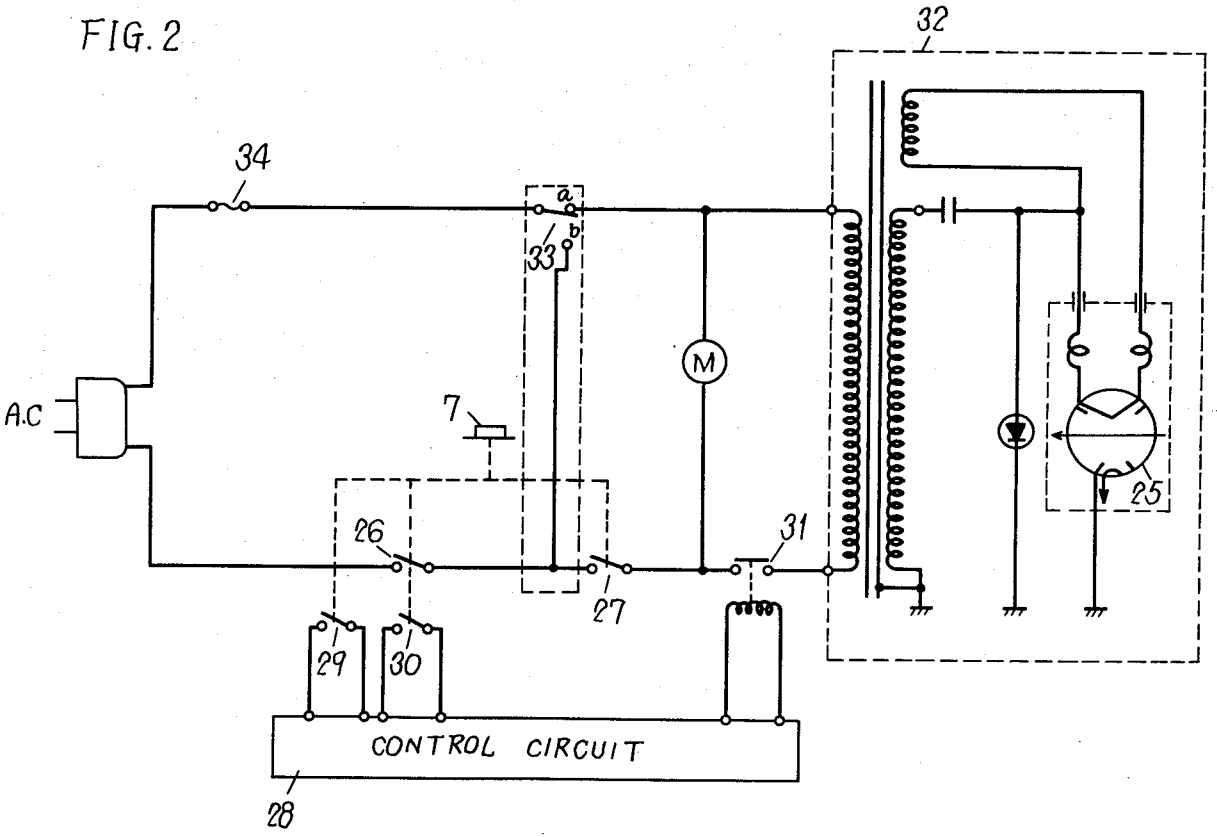
FIG. 2 is a circuit diagram of an electric circuit of the heating appliance.

With such an arrangement, upon opening the door 3 a mounting 41 for the door switch actuator 5 moves about a pivot 40 pivoted about the periphery of the opening in the heating chamber 4, in the direction C under the spring force of a spring 42, and the door switch actuator 5 is protruded as seen in FIGS. 1 and 2. As soon as the door switch actuator 5 is in the protruded position, the mounting 41 and a link lever 43 leading to the one end 39*a* of the switch lever 39 move in the direction A and the switch lever 39 also shifts in the direction A. On the other hand, when the door 3 is closed, the door 3 is closed against the force of the spring 42 so that the mounting 41 and the door switch actuator 5 travel together in the direction of the arrow D and the link lever 43 moves in the direction of the arrow B.

The switch lever 45 in the mechanical latch moves in the direction of the arrow 47 about a pivot 46 by way of the resilient actuator arm 35 to push actuators 48 for the door switches 26 and 27 and the door open/close signal switch 30 to thereby switch on those switches upon depression of the cook start button 7. The switch lever 44 is biased in the direction of the arrow 50 to engage with the switch lever 39 under the influence of a spring 49 loaded on the switch lever 39. When the door 3 is opened, the switch lever 39 travels in the direction of arrow A and the switch lever 44 travels in the direction of the arrow 51 under the influence of a spring (not shown) loaded on the switch lever 44, thus turning off the door switches 26 and 27 and the door open/close signal switch 30. A projection 52 on the switch lever 45 allows the door switch 27 to be switched on through the actuator 48 more quickly than the door switch 26 and the door open/close signal switch 30 and to be switched off more slowly than the door switch 26 and the door open/close signal switch 30. With such an arrangement, as the door 3 is placed into closed position for cooking, the monitor switch 33 and the door switches 26 and 27 are switched on. Upon depression of the cook start button 7 the cook start switch 29 is switched on via the resilient actuator arm 35 and the electronic control circuit 28 is connected in part. Furthermore, the switch lever 44 is pushed and the switch lever 45 operates to switch on the door switches 26 and 27 and the door open/close signal switch 30 and renders the main circuit operative. As a result, the electronic control circuit 28 operates to excite the electromagnetic relay 31 and thus the high frequency generator circuit 32.

The time lag, which is the main feature of the present invention, will be explained in further detail. The cook start signal switch 29 and the door open/close signal switch 30 are installed in separate positions. The cook start signal switch 29 is mounted on the electronic circuit board 28, while the door open/close signal switch 30 is mounted on the mechanical latch unit in superimposition with the door switches 26 and 27. Because the microcomputer cannot make certain whether the mechanical latch is in ON or OFF position, the door open/close signal switch 30 is assembled into the mechanical latch unit for such confirmation. Furthermore, the microcomputer needs a microcomputer switch, i.e. the cook start signal switch 29, in order to prevent various switches from being switched on and off sequentially when the mechanical latch has first been switched on and one of the selection switches is then actuated for selection of the cooking modes as described previously.

However, several switches are not always turned on in good timing relationship because of structural limitations and great difficulties lie due to the mass production requirement of the respective parts. The angles 54 of the planes 53 shown in FIG. 4 where the three switches are installed in the door switch unit are limited to 90 degrees ±1 degree due to the mass production requirement and even differences in the angles cause differences in timing between the uppermost switch 26 and the lowermost switch 27. In addition, the distance between the button 7 and the switch 29 and the point in time where the tip of the lever actuator arm 35 pushes the switch 29 upon depression of the button 7 may vary greatly depending upon different shapes of the actuator arm 35. Accordingly, pursuant to the present invention, there is provided a measure to overcome the foregoing disadvantages.

Provided that either the door open/close signal switch 30 or the cook start signal switch 29 has been turned on, the microcomputer strobes the signal periodically (every 1/10 second) until the other switch is turned on (e.g. in three seconds). Having confirmed that the other switch is in ON position, the microcomputer turns on a main circuit current switch 31.

Figure 8:
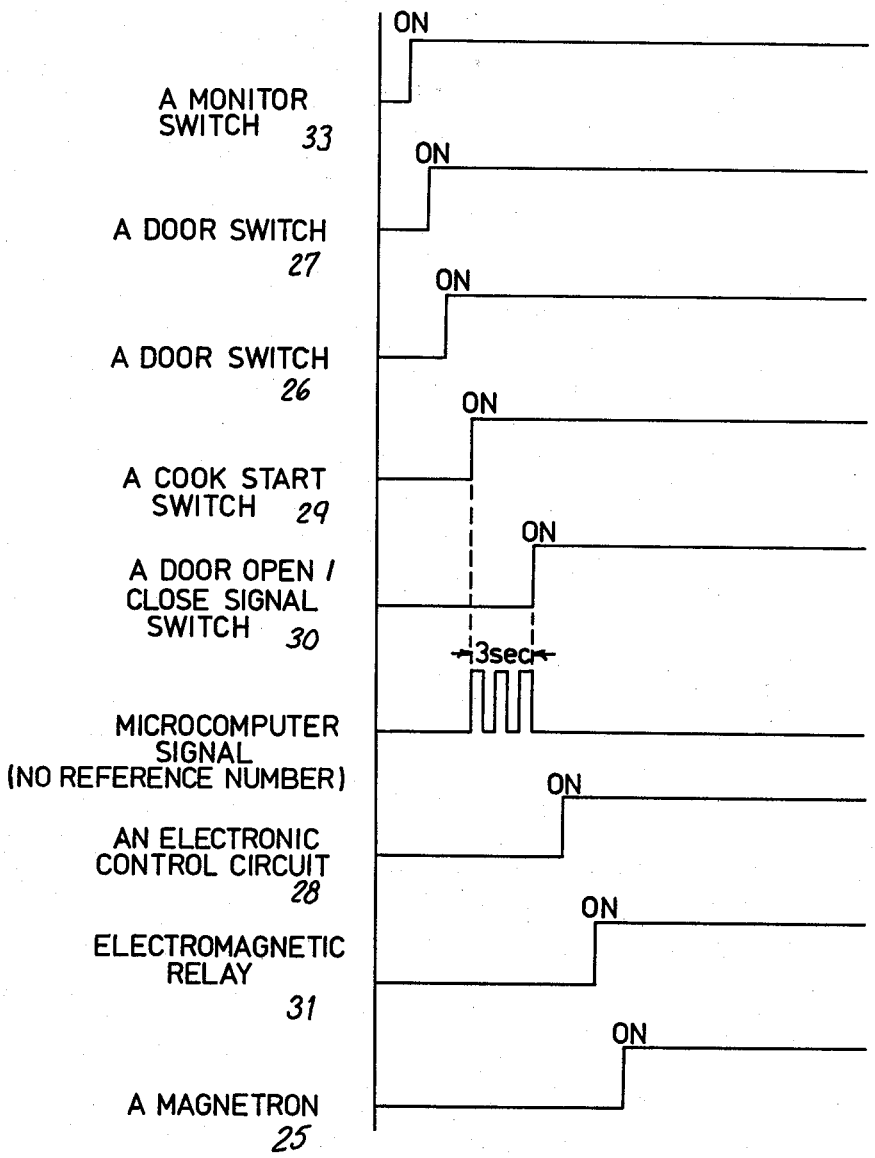
FIG. 8 is a timing chart for the heating appliance illustrated previously.

FIG. 8 shows when the respective switches, the electromagnetic relay, the electronic control circuit and the heating source (magnetron) are switched on.

INDUSTRIAL APPLICABILITY

As stated previously, the appliance embodying the present invention is adapted such that the electronic control circuit is switched on only when the input signal switch for the electronic control circuit using the mechanical latch unit, the start signal switch disposed independently of said input signal switch, and so forth are all switched on. Provided that the heating source is enabled after the electronic control circuit has been switched on, the timing relationship where the respective switches are switched on, placement of those switches, and the stroke, placement and timing relationship of the cook start button are not critical and are accurate enough to fulfill the requirement for mass production. The appliance is therefore excellent in this aspect.

Moreover, the mechanical latch may be effectively combined with the electronic control circuit by the circuit arrangement by which the entirety of the appliance is turned off unless the plurality of the signal switches are switched on within a predetermined period of time.

Safety and the user's convenience are assured through the use of the existing cook start button rather than using the power switch independently disposed.

The present appliance relies upon the combination of the mechanical latch method with the electronic control circuit as a measure to overcome static electricity, momentary power failure, a voltage drop, a surge of lightning, etc. Also, the appliance incorporating the present invention is less expensive and more convenient to use.

Whether it is the electronic circuit switch or the microswitch, the cook start switch may be actuated through the use of the resilient member according to the present invention, resulting in increased durability and reliability of the appliance.

The cook start signal switch is not actuated directly by the cook start button, so that force does not act directly on the switch mounted on the electronic circuit board nor does it break or damage copper foils. The appliance is therefore highly reliable. In addition, since the switches mounted on the electronic circuit board suitable for mass production are used rather than microswitches, the appliance is less expensive and satisfactory in economy and workability.

I claim:

1. A heating apparatus comprising:

a main body, an operational panel portion disposed on said main body, a heating chamber for receiving a food to be heated, a heat source provided for heating said food, a door for opening and closing movement in said heating chamber, a plurality of door switches being turned on and off by the opening and closing movement of said door, a main circuit for supplying said heat source with power, an electronic control circuit for controlling the main circuit for said heat source, a door open/close signal switch responsive to the turning on and off of said plurality of door switches, a cook start switch for starting the heating of said food, a cook start button means for indirectly turning on the cook start switch, said cook start button means, said plurality of door switches, said door open/close signal switch, and said cook start switch being operatively associated with each other, wherein said door open/close signal switch is rendered operative only when the plurality of door switches are turned on, said cook start switch is rendered operative only when said door open/close signal switch is operative, and said electronic control circuit is rendered operative only when the cook start switch and said door open/close signal switch are both turned on.

2. A heating apparatus as set forth in claim 1 further comprising:

a link lever means for controlling said plurality of door switches in association with the opening and closing movement of said door.

3. A heating apparatus as set forth in claim 2 further comprising:

a resilient actuator arm interposed between said cook start button means and said cook start switch.

4. A heating apparatus as set forth in claim 3, further comprising:

a circuit board means for carrying said electronic control circuit, said resilient actuator arm being mounted on said circuit board means with its one end engaging with part of said operational panel portion and its opposite end being grounded by said circuit board means.

* * * * *